US006040804A

United States Patent [19]

Harano

[11] Patent Number: 6,040,804

[45] Date of Patent: Mar. 21, 2000

[54] ANTENNA UNIT FOR PORTABLE RADIO UNIT

[75] Inventor: Nobuya Harano, Shizuoka, Japan

[73] Assignee: NEC Corporation, Tokyo, Japan

[21] Appl. No.: 09/162,166

[22] Filed: Sep. 29, 1998

[30] Foreign Application Priority Data

Sep. 30, 1997 [JP] Japan ..... 9-265604

[51] Int. Cl.[7] ..... H01Q 1/24

[52] U.S. Cl. ..... 343/702; 343/718

[58] Field of Search ..... 343/702, 718, 343/741, 866, 841, 872; 455/90; H01Q 1/24

[56] References Cited

U.S. PATENT DOCUMENTS 4,903,326 2/1990 Zakman et al. ..... 343/702
4,920,353 4/1990 Mori et al. ..... 343/702

FOREIGN PATENT DOCUMENTS 61-123303 6/1986 Japan .
7-321688 12/1995 Japan .

*Primary Examiner*—Hoanganh Le
*Attorney, Agent, or Firm*—Young & Thompson

[57] ABSTRACT

Disclose is an antenna unit for portable radio unit, which has a cell with a metal covering that is disposed opposite to a conductive plate through a dielectric member.

11 Claims, 5 Drawing Sheets

ANTENNA UNIT FOR PORTABLE RADIO UNIT

FIELD OF THE INVENTION

This invention relates to an antenna unit for portable radio unit, more particularly to, an antenna unit for portable radio unit that is miniaturized.

BACKGROUND OF THE INVENTION

In recent years, techniques for enhancement of function and miniaturization in mobile terminal units have made startling progress. However, to enhance the performance of an antenna unit, which is a major element of a mobile terminal unit, and to miniaturize it, are difficult, compared with other circuit techniques or device techniques. This is an obstacle in proceeding to miniaturize the entire mobile terminal unit. A pager, which is now the smallest one of mobile terminal units, is used mostly as it is attached to a human body. Therefore, the antenna is desired to have a high gain even when being attached to the human body. Because of this, many pagers use a loop antenna that is one of magnetic-field type antennas whose antenna gain is not deteriorated when even when being attached to the human body.

However, by the reason that the gain of loop antenna varies in proportion to the opening area of loop, it is difficult to obtain a loop opening area needed to have a gain equal to that of a larger pager when the miniaturization of pager is required. Also, with the miniaturization of pager, the distance between the loop antenna and other parts becomes short. Therefore, there is another problem that the antenna gain of loop antenna is often deteriorated because it is likely to be affected by nearby metal parts.

Japanese patent application laid-open Nos.7-3211688 (1995) titled "Built-in Antenna for Radio Unit" and 61-123303(1996) titled "Antenna for Miniature Radio Unit" disclose a technique that a cell-encasing part or cell itself is used to minimize the antenna unit of a portable radio unit as a mobile terminal unit. The former is the invention that part of a cell attachment part in the cell-encasing part is used as a loop antenna. On the other hand, the latter is the invention that a shielding case in the radio section of portable radio unit is used as an earth plate and a cell for feeding power source in the cell-encasing part shielded from the radio section is an antenna element.

The antennas disclosed above aim to minimize the size by using the space for the cell-encasing part. However, such a technique cannot meet further requirements as to the miniaturization and the enhancement of performance any more because the requirements to mobile terminal unit or portable radio unit are rapidly increased in recent years.

SUMMARY OF THE INVENTION

Accordingly, it is an object of the invention to provide an antenna unit for portable radio unit that can meet further requirements as to the miniaturization and the enhancement of performance in various portable radio units.

According to the invention, an antenna unit for portable radio unit, comprises: a cell with a metal covering that is disposed opposite to a conductive plate through a dielectric member.

For example, the antenna unit for portable radio unit has the cell with a cylindrical metal covering that is disposed opposite to the conductive plate (generally, a metal plate) through the dielectric member. This antenna unit is lightened by using a plastic case, and can be used for a more miniaturized portable radio unit. Its cell-encasing part (cell case) is, in general, composed by a conductive plate and a dielectric member that are disposed near the case. The cell to feed power to the portable radio unit is in contact with the dielectric member. With the cell disposed thus, the conductive plate and the cell operate as an antenna element (radiation element).

Namely, in this portable radio unit, the antenna-mounting part can be omitted (saved) by encasing the antenna simultaneously with the cell in the cell-encasing part. Thus, the miniaturization of device can be attained greatly. Also, the dielectric member is effective in changing and regulating the operating frequency (resonance frequency) according to the dielectric constant. Reduction of operating frequency due to the placement of the dielectric member between the conductive plate and the cell enhances the miniaturization of the antenna unit.

BRIEF DESCRIPTION OF THE DRAWINGS

The invention will be explained in more detail in conjunction with the appended drawings, wherein.

DESCRIPTION OF THE PREFERRED EMBODIMENTS

Figure 1A:
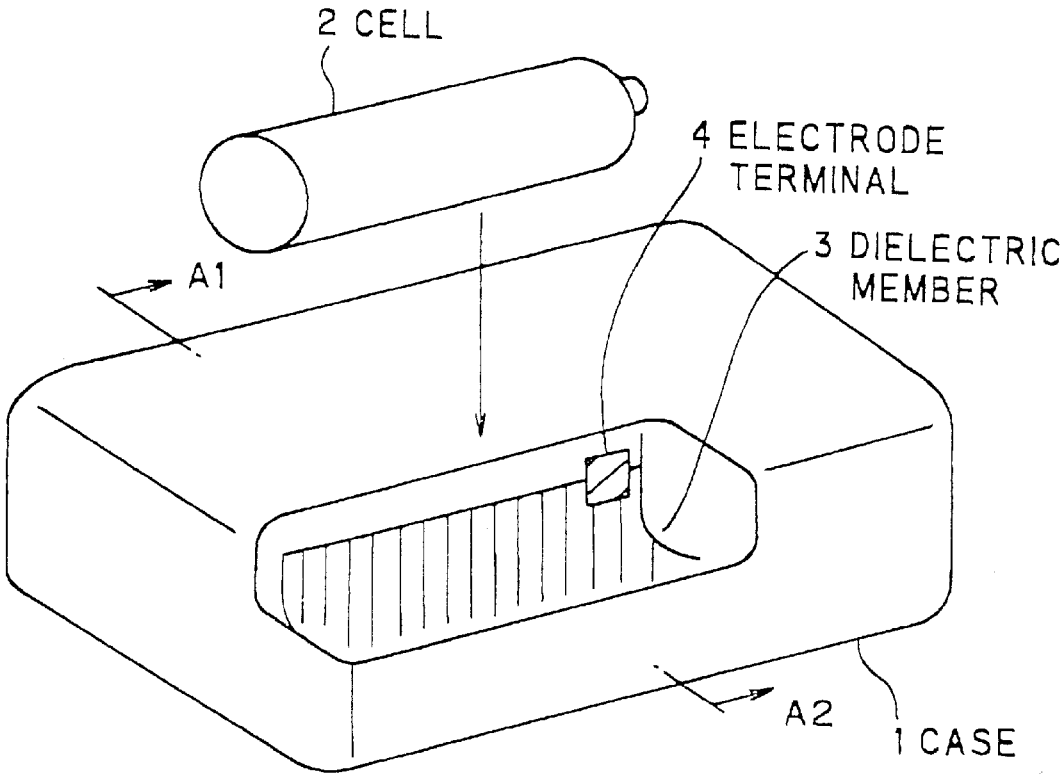
FIG. 1A is a broken perspective view showing an antenna unit for portable radio unit in a first preferred embodiment according to the invention.

Next, the present invention will be explained referring to the drawings.

Figure 1B:
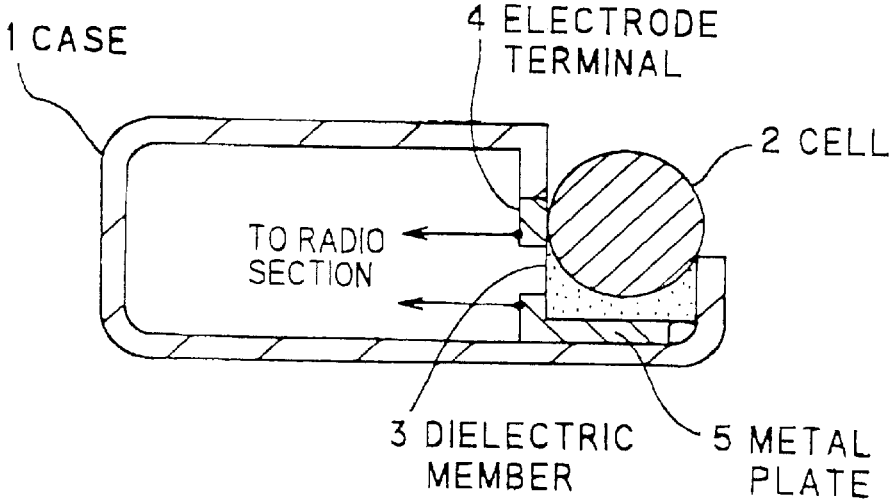
FIG. 1B is a cross sectional view cut along the line A1–A2 in FIG. 1A.

FIGS. 1A and 1B are constructional illustrations showing the first embodiment according to the present invention. FIG. 1A is a broken perspective view, and FIG. 1B is a cross sectional view cut along the line A1–A2 in FIG. 1A in the state that a cell 2 is encased in. Meanwhile, in FIGS. 1A and 1B, a cell lid to be attached to a case 1 to protect the cell 2 is removed.

A pager is supposed as a portable radio unit for the embodiment in FIGS. 1A and 1B. This is applied to the second embodiment and the other embodiments as well. The case 1 separates a main encasing part that encases a main circuit including a radio section and a cell-encasing part that encases the dry cell ("dry element battery", hereinafter simply "cell") 2, and it encases these circuits. The cell 2 has a nearly cylindrical shape and is covered with a metal covering formed to insulate the positive electrode. Meanwhile, as the cell 2, a rectangular-column-shaped cell may be also used. A metal plate 5, which is a conductive plate with a length nearly equal to that of the cell 2, is attached onto the bottom of the cell-encasing part along the case 1 and part (side wall) of the cell-encasing part in the direction of a partition board. A dielectric member 3 to support the cell 2 is disposed over the bottom of the metal plate 5. Namely, the cell 2 with the metal covering is disposed being opposite through the dielectric member 3 to the metal plate 5 as a conductive plate. Meanwhile, the dielectric member 3 is formed to have such a shape that reduces space between the dielectric member 3 and the cell 2 as much as possible, to exert its dielectric effect as much as possible. In this composition, part that the dielectric member 3 contacts the cell 2 is also formed to have a concave arc because the cell 2 is cylindrical.

An electrode terminal 4, which is a conductive member, is formed as part of the case 1 at a position (side of the cell-encasing part) nearest to the case 1 adjacent to one end of the cell 2. The outer tube (metal covering) of the cell 2 is generally covered with a thin insulator (dielectric) such as a coat of paint, and the metal covering of the cell 2 is high-frequency coupled with the electrode terminal 4 by capacitive reactance. The metal plate 5 and the electrode terminal 4 compose a connecting interface between the radio section and the antenna unit.

In the composition in FIGS. 1A and 1B, the metal plate 5 and the cylindrical part (metal covering part) of the cell 2 connected to the electrode terminal 4 are composing a resonance circuit, and this circuit operates as an antenna at a resonance frequency. The resonance frequency of the antenna is varied by the dielectric constant of the dielectric member 3, and the clearance between the metal plate 5 and the cell 2, i.e., the thickness of the dielectric member 3. For example, when the dielectric constant of the dielectric member 3 is increased, the resonance frequency is reduced, and therefore the antenna unit can be miniaturized at a same frequency. Meanwhile, in this composition, it is hard for the resonance frequency to be affected by a nearby metal piece. Therefore, there is also the merit that the position of antenna can be relatively freely chosen. Also, by changing the shape of the metal plate 5, the radiation directional characteristic of antenna can be also varied, thereby obtaining a necessary antenna characteristic.

In the antenna of the first embodiment in FIG. 1, part that has been used only as the cell-encasing part is made to be a part of the antenna. Further, the cell 2 itself is also made to be a part of the antenna. Thereby, the rate of the antenna to the volume of the entire portable radio unit can be increased. As a result, the efficiency or gain of antenna can be enhanced. Also, the space of antenna can be reduced to such a degree that its substantial body is little observed. Therefore, there is the effect that a smaller portable radio unit can be produced. This effect can be further enhanced by filling the dielectric member 3 into a dead space.

Figure 2:
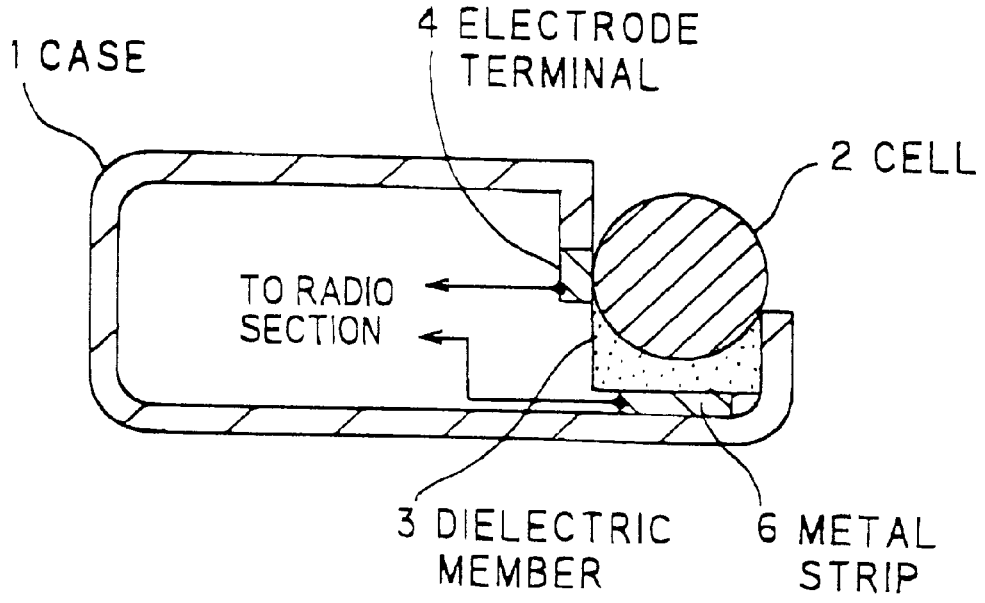
FIG. 2 is a cross sectional view showing an antenna unit for portable radio unit in a second preferred embodiment according to the invention.

FIG. 2 is a cross sectional view showing the second embodiment according to the present invention.

The antenna unit in the second embodiment is composed by changing the metal plate 5 in FIG. 1B into a metal strip 6 to be attached only onto the bottom surface of the case 1. The length of the metal strip 6 may be nearly equal to that of the metal plate 5. This composition can be regarded as a dielectric strip antenna that has the cell 2 as an earth element (earth conductor) and the metal strip 6 as a radiation element. By covering the outside of the cell 2 and part of the case 1 with a shield plate etc. and attaching a metal plate etc. to the cell 2 to enlarge the earth conductor, the antenna can further have a higher gain. Also, by changing the size (width in FIG. 2) or the position (to the right or left side in FIG. 2) of the metal strip 6, the radiation directional characteristic etc. can be controlled. For example, by narrowing the width of the metal strip and placing it on the corner of the cell-encasing part, the resonance frequency can be lowered.

Figure 3:
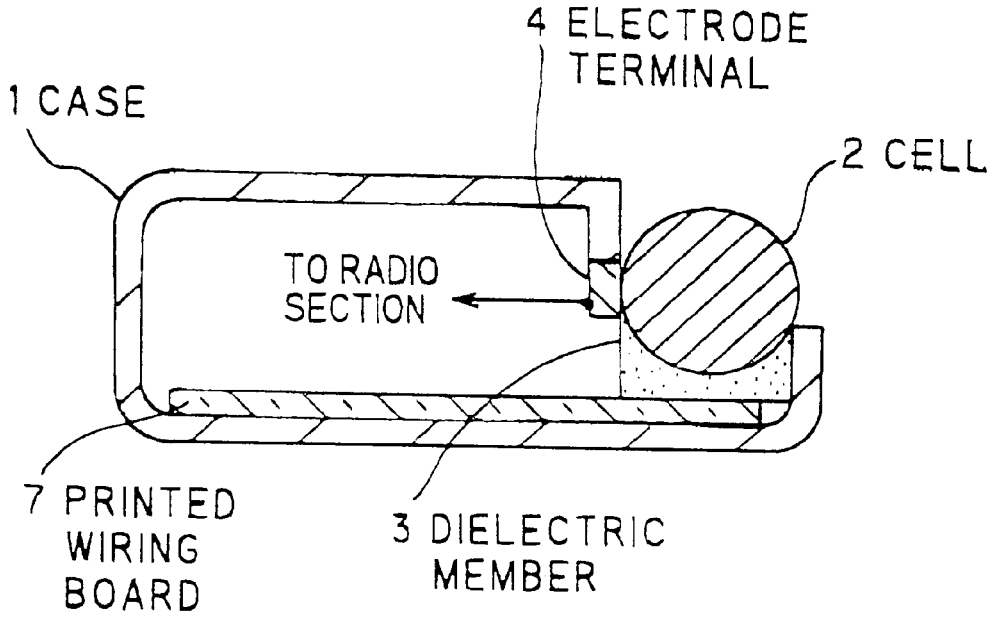
FIG. 3 is a cross sectional view showing an antenna unit for portable radio unit in a third preferred embodiment according to the invention.

FIG. 3 is a cross sectional view showing the third embodiment according to the present invention.

The antenna unit in the third embodiment is composed by changing the metal plate 5 in FIG. 1B into a printed wiring board 7, where pieces for the radio section are mounted, to be attached only onto the bottom surface of the case 1. Though the conductor surface of the printed wiring board 7 in the radio section 5 almost extends over the bottom surface of the case 1, it is, in the cell-encasing part, disposed to locate only between the dielectric member 3 and the case 1. In this composition, there is the effect that the coupling loss between the antenna unit and the radio section can be reduced because the antenna conductor can be directly connected with the printed wiring board 7 used in the radio section. Also, there is the effect that the antenna conductor can be produced more precisely and inexpensively. Meanwhile, on the conductor surface of the printed wiring board 7 as the antenna conductor, various patterns, such as helical, spiral etc., can be formed.

Figure 4:
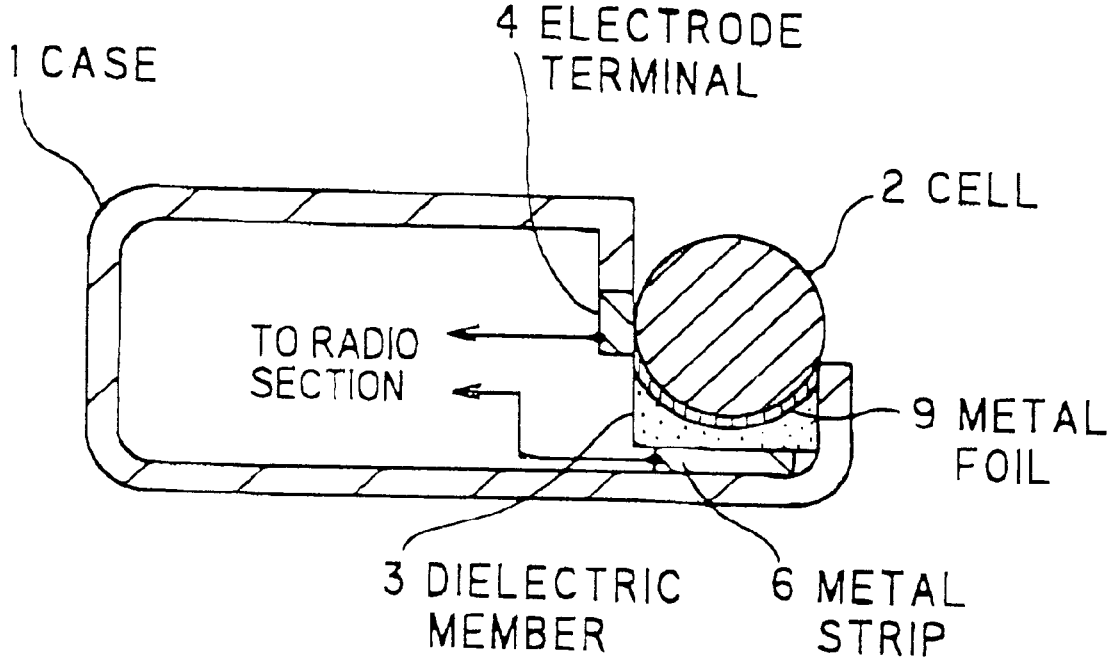
FIG. 4 is a cross sectional view showing an antenna unit for portable radio unit in a fourth preferred embodiment according to the invention.

FIG. 4 is a cross sectional view showing the fourth embodiment according to the present invention.

The antenna unit in the fourth embodiment is composed by adding a metal foil 9 to the composition in FIG. 2. The metal foil 9 can be most stably located by disposing it on part where the cell 2 contacts the dielectric member 3. Also, the metal foil 9 is connected with the electrode terminal 4. The metal foil 9 stably forms large capacitive reactance between the metal foil 9 and the covering of the cell 2 over a large area. This composition is particularly effective for the absorption of a variation in antenna characteristic due to the dispersion of shape of the cell 2. Also, due to the direct connection of the metal foil 9 to the electrode terminal 4, the high-frequency coupling between the antenna unit and the radio section is changed from capacitive coupling to direct coupling. Thereby, the coupling between them is provided with a low loss and becomes stable.

Figure 5A:
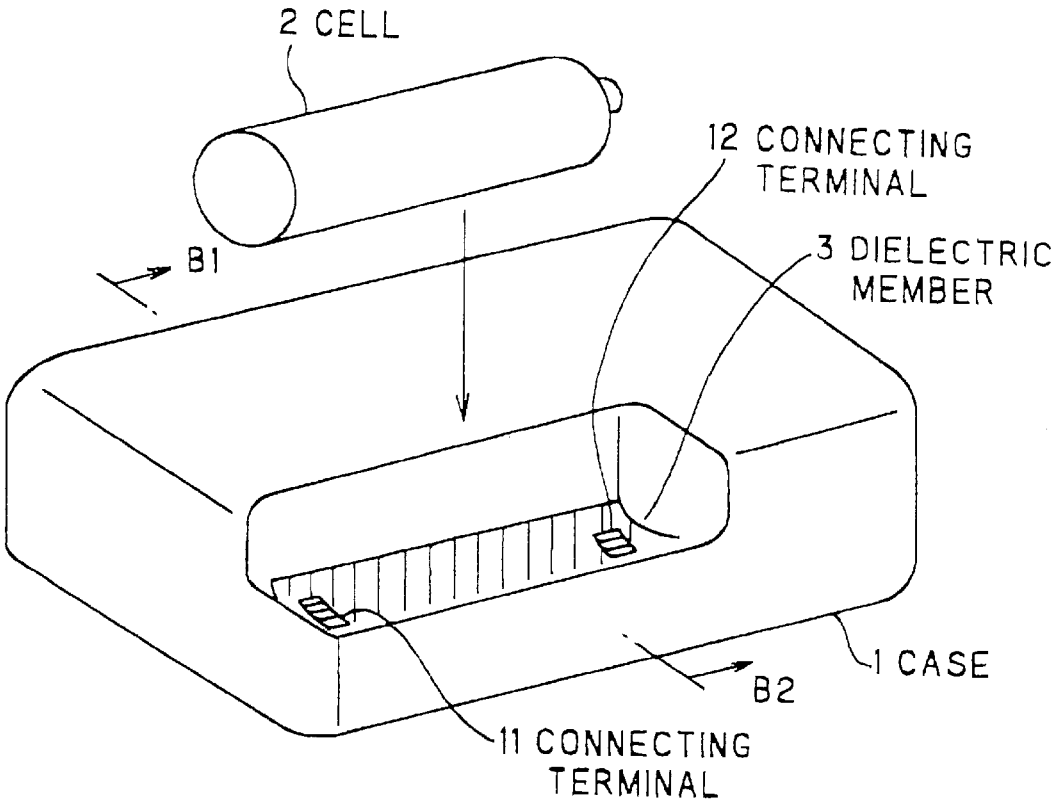
FIG. 5A is a broken perspective view showing an antenna unit for portable radio unit in a fifth preferred embodiment according to the invention.
Figure 5B:
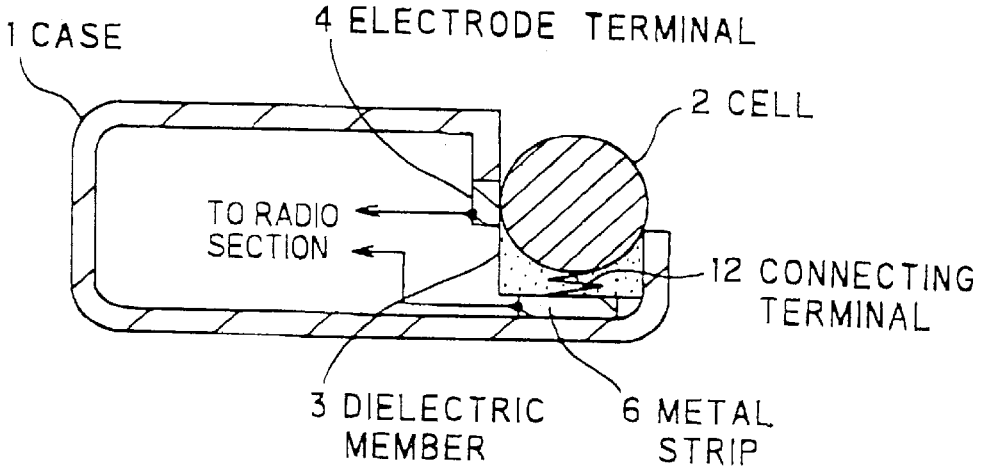
FIG. 5B is a cross sectional view cut along the line B1–B2 in FIG. 5A.

FIGS. 5A and 5B are constructional illustrations showing the fifth embodiment according to the present invention. FIG. 5A is a broken perspective view, and FIG. 5B is a cross sectional view cut along the line B1–B2 in FIG. 5A in the state that a cell 2 is encased in. Meanwhile, in FIGS. 5A and 5B, the cell lid to be attached to the case 1 to protect the cell 2 is removed.

The antenna unit in the fifth embodiment is composed by connecting the cell 2 and the metal strip 6 in the second embodiment in FIG. 2 through connecting terminals 11 and 12. The connecting terminal 11 of a metal plate, which is connected with the metal strip 6, is disposed near one end surface of the cell 2. The connecting terminal 12 of a metal plate, which is connected with the metal strip 6, is disposed near another end surface of the cell 2. By connecting the metal covering of the cell 2 and the metal strip 6 by the connecting terminals 11 and 12 while penetrating through the dielectric member 3, a loop antenna is formed. The connection between this loop antenna and the radio section is, like the second embodiment in FIG. 2, given by the electrode terminal 4 and the metal strip 6.

Figure 6:
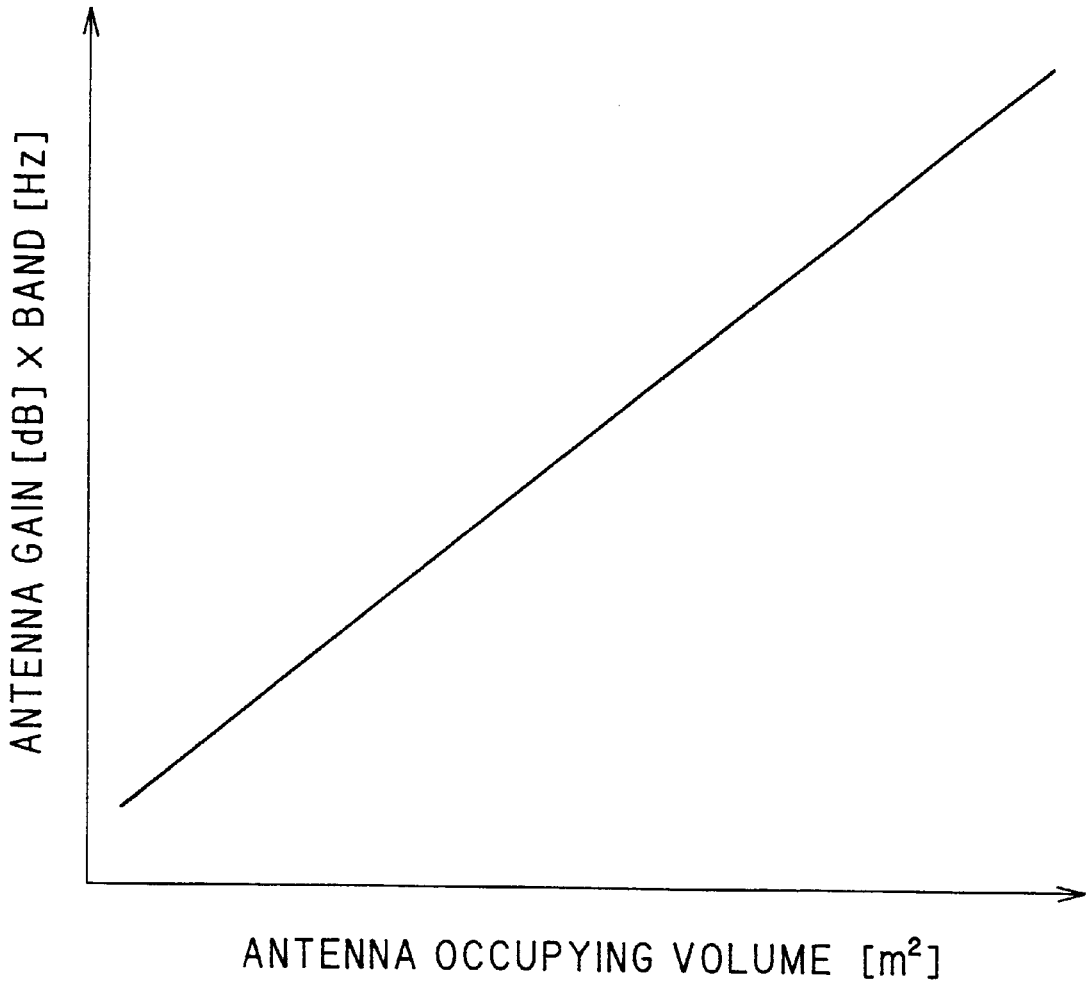
FIG. 6 is a diagram showing an antenna gain bandwidth to an occupying volume of the antenna unit for portable radio unit according to the invention.

FIG. 6 is a diagram showing an antenna gain bandwidth to an occupying volume of the antenna unit for portable radio unit according to the present invention.

As shown, antenna gain (dB)×band (Hz) of the antenna unit is proportional to antenna occupying volume (square meters).

As described above, the antenna units in the first to fifth embodiments use part that has been used only as the cell-encasing part (case), as the antenna. Thus, a specific part (volume) for the antenna unit is not necessary. Further, the cell 2 itself in the cell casing part that occupies rather a large volume in the portable radio unit is also used as an antenna element. Therefore, a large occupied volume can be obtained. Accordingly, the present invention affords the effect that the miniaturization and the enhancement of performance can be attained without being aware of the size of the antenna unit.

Advantages of the Invention:

As described above, in the antenna unit for portable radio unit according to the invention, by disposing the cell with the metal covering to be opposite to the conductive plate through the dielectric member, part of the cell-encasing part to encase the cell, and even the cell itself, can be used as the antenna unit. As a result, the size of the antenna unit for portable radio unit is limited to within the cell-encasing part. In designing the portable radio unit, the miniaturization and the enhancement of performance can be attained without being aware of the size of the antenna unit.

Also, when this antenna unit is provided with an earth plate to shield the respective parts, the antenna gain is, to the contrary, likely to increase, compared with conventional loop antennas. Thus, metal shields may be often used to prevent the high-frequency noise of the respective circuits. Therefore, there is also the effect that degree of freedom in designing a portable radio unit can be enhanced.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching here is set forth.

What is claimed is:

1. An antenna unit for portable radio unit, comprising:

a cell with a metal covering that is disposed opposite to a conductive plate through a dielectric member.

2. An antenna unit for portable radio unit, according to claim 1, wherein:

said conductive plate is a metal plate disposed on one surface of a cell-encasing part of the portable radio unit.

3. An antenna unit for portable radio unit, according to claim 1, wherein:

said metal covering of said cell and said conductive plate form a radiation element of a dielectric strip antenna.

4. An antenna unit for portable radio unit, according to claim 1, wherein:

said metal covering of said cell is high-frequency-coupled with one of radio-signal input terminals of the portable radio unit.

5. An antenna unit for portable radio unit, according to claim 1, wherein:

said metal covering of said cell is nearly cylindrical.

6. An antenna unit for portable radio unit, according to claim 1, wherein:

said conductive plate is a metal strip extending in the axis direction of said cell.

7. An antenna unit for portable radio unit, according to claim 1, wherein:

said conductive plate is a printed wiring board.

8. An antenna unit for portable radio unit, according to claim 7, wherein:

said printed wiring board has pieces for radio section mounted on said printed wiring board.

9. An antenna unit for portable radio unit, according to claim 1, further comprising:

a metal foil disposed between said cell and said conductive plate, said metal foil being directly connected with a radio section of the portable radio unit.

10. An antenna unit for portable radio unit, according to claim 1, wherein:

said cell is connected with said conductive plate at positions near one end surface of said cell and another end surface to form a loop antenna.

11. An antenna unit for portable radio unit, according to claim 10, wherein:

said metal covering of said cell and said conductive plate are high-frequency-coupled with a radio section of the portable radio unit.

* * * * *